US008910891B2

(12) United States Patent
Sharp

(10) Patent No.: US 8,910,891 B2
(45) Date of Patent: Dec. 16, 2014

(54) COMMINUTION OF WASTE AND OTHER MATERIALS

(75) Inventor: Rodney Warwick Sharp, Hamilton (NZ)

(73) Assignee: Progressive IP Ltd., Hamilton (NZ)

( * ) Notice: Subject to any disclaimer, the term of this patent is extended or adjusted under 35 U.S.C. 154(b) by 614 days.

(21) Appl. No.: 13/255,018

(22) PCT Filed: Mar. 7, 2010

(86) PCT No.: PCT/NZ2010/000039

§ 371 (c)(1),
(2), (4) Date: Dec. 22, 2011

(87) PCT Pub. No.: WO2010/101483

PCT Pub. Date: Sep. 10, 2010

(65) Prior Publication Data

US 2012/0085848 A1 Apr. 12, 2012

(30) Foreign Application Priority Data

Mar. 6, 2009 (NZ) ..... 575359

(51) Int. Cl.

| | |
|---|---|
| ***B02C 17/10*** | (2006.01) |
| ***B02C 17/02*** | (2006.01) |
| ***B02C 15/16*** | (2006.01) |
| ***B02C 17/00*** | (2006.01) |
| ***B02C 17/18*** | (2006.01) |
| ***B02C 17/24*** | (2006.01) |

(52) U.S. Cl.

CPC ..... *B02C 17/02* (2013.01); *B02C 15/16* (2013.01); *B02C 17/002* (2013.01); *B02C 17/007* (2013.01); *B02C 17/10* (2013.01); *B02C 17/1805* (2013.01); *B02C 17/24* (2013.01)

USPC ..... 241/36; 241/85; 241/228; 241/236

(58) Field of Classification Search

USPC ..... 241/235, 236, 36, 228, 85, 88, 89.3, 91

See application file for complete search history.

(56) References Cited

U.S. PATENT DOCUMENTS

| | | | | | |
|---|---|---|---|---|---|
| 210,471 | A | * | 12/1878 | Senderling | 241/228 |
| 244,316 | A | * | 7/1881 | Sample | 99/621 |
| 1,736,394 | A | * | 11/1929 | Dierker | 241/161 |
| 2,642,231 | A | * | 6/1953 | Illig | 241/38 |
| 5,743,475 | A | | 4/1998 | Catani | |

FOREIGN PATENT DOCUMENTS

| | | |
|---|---|---|
| EP | 0704245 | 4/1996 |
| JP | 9173883 | 7/1997 |
| JP | 10005610 | 1/1998 |
| WO | WO 95/17967 | 7/1995 |

OTHER PUBLICATIONS

International Search Report, PCT/NZ2010/000039, Jul. 13, 2010.

* cited by examiner

*Primary Examiner* — Mark Rosenbaum
(74) *Attorney, Agent, or Firm* — Young & Thompson

(57) ABSTRACT

Comminution apparatus is described which is tailored for the processing of green, soft, and fibrous waste. Inner and outer comminution drums bear projecting macerating features which can progressively interact to provide a shearing action on material on waste within the outer comminution drum. Screening apertures on the outer comminution drum allow for the exit of comminuted material.

20 Claims, 4 Drawing Sheets

33
2
33
34
8
6
9

1
2
10
3
5
11
11
9

COMMINUTION OF WASTE AND OTHER MATERIALS

TECHNICAL FIELD

The invention relates generally apparatus for the comminution and screening of solid materials into smaller fragments, and particularly the comminution of green waste and municipal refuse.

BACKGROUND ART

The applicant has previous invented apparatus for the comminution of solid materials, these being the subject of published patent applications WO/2005/092509 and WO/2006/093421. These inventions focus more on the comminution of firm materials such as waste wood and timber into a material commonly referred to as hog fuel, though were also able to be used for a range of other solid materials including demolition waste. The inventions relied on a rotating disk with teeth which basically chipped material as it came into contact therewith.

However, a limitation of the invention was that it worked best with material which did not have a high moisture content and which responding well to a chipping action—e.g. woody and brittle materials. In practice, stringy fibrous materials such as flax could eventually clog the machine, its screening apertures, and/or reduce its operating efficiency. Hence the apparatus worked best with non-fibrous materials which responded well to chopping, breaking, or shattering by impact.

Green waste and municipal waste represent a significant problem world wide. Green waste often comprises a high proportion of leafy and green material interspersed with woody material such as branches. There may also be a significant proportion of stringy and fibrous material. This type of waste can be bulky due to large air voids and pockets arising from the typically varied composition of this waste, and comprises materials of substantially different size—from branches and limbs, through to small individual pieces such as lawn clippings. These issues represent a problem for composting—for efficient composting ideally all the material is of a similar size (and ideally blended), and absent of large air pockets. Hence, some processing of the material is desirable to both reduce bulk and increase composting efficiency. The problem is that prior art apparatus suitable for chipping or comminution woody material is often clogged by moist and non-woody material—this requires a preliminary separation step which adds to the cost of recycling and often requires a larger recycling plant area so as to hold the separated materials. The problem still remains as to how to process the separated, and problematic, materials.

As land becomes scarcer, waste and recycling centres with as small a footprint as possible are desirable. A smaller footprint also allows such centres to be situated in urban and suburban areas—this also reduces the carbon footprint for dealing with the waste as it can significantly reduce the distance that green and garden waste material needs to be transported for recycling.

Accordingly, there is a need for apparatus which can comminute common green waste, ideally without initial separation steps, and which can reduce the overall footprint of a waste or recycling management centre for handling green waste. Apparatus which can comminute green waste to a relatively uniform size to facilitate efficient composting into a valuable recyclable commodity, is also desirable. In terms of sustainability, converting waste material into a valuable usable commodity is both economically and environmentally sound, and can subsidise the operation of municipal (and other) waste management centres.

Similar problems also exist for municipal refuse. While recycling programmes are in place in many regions, typical municipal waste often comprises predominantly moist material of a wide range of compositions. Accordingly, apparatus for comminution municipal waste may need to comminute a bulk material which can contain materials as diverse as: disposable diapers, metal cans, bottles, paper and cardboard, plastic bags and bottles, food waste, and whatever else the average consumer decides to put in their waste. Conventional shredders (such as used for woody materials) quickly clog when processing such material, and may only be able to process municipal waste when it is blended with a larger proportion of other materials (e.g. woody material, etc.). Such a solution is not practical and also combines a potentially valuable commodity (green waste) with waste which is often incinerated or buried.

A significant problem in waste management is bulk. Comminution of waste can provide a number of potential advantages—it is more amenable to screening and separation processes which can isolate recyclable materials. It also produces an easily compactable mass, and in landfill sites the waste breaks down much more quickly than bulk waste (another major issue).

There are limited, if any, options known to the inventor allowing the wide range of materials present in bulk municipal waste to be comminuted by one piece of apparatus. Apparatus suitable for woody and hard materials don't like wet or stringy materials. Apparatus for comminution soft materials general balk or stop in the presence of hard or large materials. Fibrous stringy materials tend to represent a problem for all types of apparatus if present in significant amounts.

Accordingly there is a need for apparatus able to comminute both soft and harder waste materials without discrimination. There is particularly a need for apparatus suitable for comminution general green waste and/or municipal waste without the need for wholesale screening or separation of large amounts of material before it is processed by the comminution apparatus.

Accordingly it is an object of the present invention to consider the foregoing problems and provide apparatus which can process a wide range of waste materials with varying moisture contents and composition.

At the very least, it is an object of the present invention to provide the public with a useful choice.

Further aspects and advantages of the present invention will become apparent from the ensuing description which is given by way of example only.

DISCLOSURE OF THE INVENTION

According to one aspect of the present invention there is provided comminution apparatus comprising an outer comminution drum and at least one inner comminution drum, said outer comminution drum having a hollow portion and having a longitudinal axis, a said inner comminution drum having a longitudinal axis and positioned to be present within said hollow portion outer comminution drum, said longitudinal axes being substantially parallel to each other, but not coaxial, at least one of said outer comminution drum, and an inner comminution drum, being rotatable about its longitudinal axis;

a said inner comminution drum having at least one inner drum projecting macerating feature on its outer surface, said outer comminution drum having at least one outer drum projecting macerating feature on its inner surface, and in which during rotation of at least one of said outer comminution drum, and an inner comminution drum, about its longitudinal axis said projecting macerating features come into close proximity, but do not make contact, with each other.

According to another aspect of the present invention there is provided comminution apparatus, substantially as described above, in which an inner drum projecting macerating feature comprises one or more of: a tooth, a grouping of teeth, an abrasive element, a raised projection.

According to another aspect of the present invention there is provided comminution apparatus, substantially as described above, in which an outer drum projecting macerating feature comprises one or more of: a tooth, a grouping of teeth, an abrasive element, a raised projection.

According to another aspect of the present invention there is provided comminution apparatus, substantially as described above, in which one or more inner drum projecting macerating features are arranged in a helical fashion about the outer surface of an inner drum;

According to another aspect of the present invention there is provided comminution apparatus, substantially as described above, in which one or more outer drum projecting macerating features are arranged in a helical fashion about the inner surface of an outer drum;

According to another aspect of the present invention there is provided comminution apparatus, substantially as described above, in which the relative positions of the inner and outer drums are such that projecting macerating features on either or both come into close proximity to the other drum than that with which said projecting macerating features are associated; close proximity being a distance less than the maximum height that a projecting macerating feature rises above the general surface of the drum from which it projects.

According to another aspect of the present invention there is provided comminution apparatus, substantially as described above, in which one or more of said inner and drums rotate, and in which projecting macerating features are provided on both inner and outer drums; the arrangement of the projecting macerating features being such that during said rotation of one or more drums the projecting macerating features come into close proximity to each other when measured in a direction parallel to the longitudinal axis of a drum, and wherein close proximity means less than the average closest distance of separation of the general surface of the drums with which said macerating features are associated.

According to another aspect of the present invention there is provided comminution apparatus, substantially as described above, in which inner and outer drums rotate, and in which inner drum projecting macerating features of each come into close proximity to outer drum projecting macerating features during rotation, but do not physically contact, a majority of the projecting macerating features of said inner and outer drums being arranged in a helical pattern about the drum with which they are associated.

According to another aspect of the present invention there is provided comminution apparatus, substantially as described above, in which projecting macerating features are arranged in multiple helical patterns about a drum with which they are associated.

According to another aspect of the present invention there is provided comminution apparatus, substantially as described above, in which, additionally, inner drum projecting macerating features come into close proximity to the general surface of the outer drum, and outer drum projecting macerating features come into close proximity to the general surface of an inner drum.

According to another aspect of the present invention there is provided comminution apparatus, substantially as described above, in which the longitudinal axis of said outer and inner drums are also the rotational axis of said drums.

According to another aspect of the present invention there is provided comminution apparatus, substantially as described above, in which an outer drum is able to be rotated independently of an inner drum.

According to another aspect of the present invention there is provided comminution apparatus, substantially as described above, in which an inner drum is able to be rotated independently of an outer drum.

According to another aspect of the present invention there is provided comminution apparatus, substantially as described above, in which one drum is driven.

According to another aspect of the present invention there is provided comminution apparatus, substantially as described above, in which both drums are driven.

According to another aspect of the present invention there is provided comminution apparatus, substantially as described above, in which the driven rotational speed of a drum is varied according to the determined load acting on one or more drums.

According to another aspect of the present invention there is provided comminution apparatus, substantially as described above, in which both inner and outer drums are rotatable, and are driven to rotate within an a relative ratio of 1:1 to 1:10 (inclusive) representing the ratio of inner:outer drum rotational speed in revolutions per minute.

According to another aspect of the present invention there is provided comminution apparatus, substantially as described above, in which the ratio of driven speeds of inner and outer drums are variable.

According to another aspect of the present invention there is provided comminution apparatus, substantially as described above, in which the ratio of driven speeds of the inner and outer drums are varied according to the determined load acting on one or more drums.

According to another aspect of the present invention there is provided comminution apparatus, substantially as described above, in which the determined load relies on detecting the actual load acting on one or more drums.

According to another aspect of the present invention there is provided comminution apparatus, substantially as described above, in which the determined load relies on information from a torque sensor on one or more drums.

According to another aspect of the present invention there is provided comminution apparatus, substantially as described above, in which at least one drum is capable of reverse rotation.

According to another aspect of the present invention there is provided comminution apparatus, substantially as described above, in which reverse rotation is initiated when a determined load acting on one or more drums exceeds a predetermined threshold.

According to another aspect of the present invention there is provided comminution apparatus, substantially as described above, in which after reverse rotation is initiated, normal rotation is reinitiated.

According to another aspect of the present invention there is provided comminution apparatus, substantially as described above, in which rotation of a drum is powered by one or more of: hydraulics, pneumatics, and electrically.

According to another aspect of the present invention there is provided comminution apparatus, substantially as described above, in which when a high torque, over a predetermined threshold is encountered on one or more of torque sensors, drive means for either or both of inner and outer comminution drums is controlled to effect at least one of i) the apparatus is stopped for manual clearing of an obstruction;

ii) the apparatus is reversed then stopped for manual clearing of an obstruction;

iii) the apparatus is reversed, then restarted (optionally at a different speed);

iv) the sequence of option (iii) is performed and if an obstruction is then re-sensed, then the sequence of option (iii) is repeated a predetermined number of times, and should the obstruction not be dealt with by the repeated reversing and restarting, then the sequence of option (i) or (ii) subsequently occurs;

v) information is sent to an operator who can select what options are to occur, with failsafe options (such as in (i) through (iv) above) if no action is taken.

According to another aspect of the present invention there is provided comminution apparatus, substantially as described above, including load sensing means for assessing the load on either or both of inner and outer comminution drums and wherein for a sensed light load (i.e. <25% of the maximum rated load of the drive means for the drums whose load is monitored) then the ratio of the rotational speed (in rpm) of the inner:outer drums should be within the inclusive range of 0.25:1 to 1:3.

According to another aspect of the present invention there is provided comminution apparatus, substantially as described above, including load sensing means for assessing the load on either or both of inner and outer comminution drums and wherein for a sensed high load (i.e. >70% of the maximum rated load of the drive means for the drums whose load is monitored) then the ratio of the rotational speed (in rpm) of the inner:outer drums should be within the inclusive range of 1:7 to 1:15

According to another aspect of the present invention there is provided comminution apparatus, substantially as described above, including load sensing means for assessing the load on either or both of inner and outer comminution drums and wherein for a sensed medium load (i.e. 25-70% of the maximum rated load of the drive means for the drums whose load is monitored) then the ratio of the rotational speed (in rpm) of the inner:outer drums should be within the inclusive range of 1:3 to 1:7.

According to another aspect of the present invention there is provided comminution apparatus, substantially as described above, in which the ratio of the outer diameter of an inner drum to the inner diameter of the outer drum is within the inclusive range of 1:2 through to 1:10.

According to another aspect of the present invention there is provided comminution apparatus, substantially as described above, in which the outer drum includes a plurality of screening apertures.

According to another aspect of the present invention there is provided comminution apparatus, substantially as described above, in which the outer comminution drum rests at least partially on one or more supporting rollers.

According to another aspect of the present invention there is provided comminution apparatus, substantially as described above, in which the longitudinal axis of the outer comminution drum is within the range of 0-30° to the horizontal.

According to another aspect of the present invention there is provided comminution apparatus, substantially as described above, which includes product collection apparatus for collecting macerated material passing through said screening apertures.

According to another aspect of the present invention there is provided comminution apparatus, substantially as described above, in which the product collection apparatus comprises a conveyor.

According to another aspect of the present invention there is provided comminution apparatus, substantially as described above, which includes a feed conveyor to load raw material to inside the hollow portion of the outer drum.

According to another aspect of the present invention there is provided comminution apparatus, substantially as described above, in which the apparatus is mounted on a vehicle, trailer, or other transportation device.

According to another aspect of the present invention there is provided comminution apparatus, substantially as described above, in which one or more projecting macerating features on either or both an inner and outer drum are arranged in a concentric fashion relative to the longitudinal axis of the drum with which they are associated.

The present invention comprises comminution apparatus for processing a variety of wastes, including but not restricted to: green wastes, garden wastes, solid agricultural wastes, municipal wastes, and a variety of other wastes comprising soft to hard materials. In practice however, most embodiments will not process materials such as heavy steels (e.g. reinforcing bars and structural steel), very hard rocks, and large woody waste (e.g. tree trunks). Modifications, however, may be made to various embodiments to handle the occasional piece of material such as mentioned above, though the typical embodiments described by way of example are more optimised to standard green and municipal waste—the skilled reader in light of this description will be able to modify the apparatus, if they desire, to cater for the odd foreign object of a non-desired type.

Preferred embodiments of the present invention comprise an outer comminution drum. This may be stationary or rotatable. In preferred embodiments the outer comminution drum is rotatable in both directions.

The outer comminution drum has a hollow portion into which raw waste materials can be inserted for comminution. The size of the drum and hollow portion (which typically extends close to the entire longitudinal length of the drum) are chosen according to user need, and reflects the amount of raw waste material to be processed at any time. A typical transportable embodiment of comminution apparatus may have a drum with an internal diameter of 1.8 to 3.0 m. Larger and smaller embodiments are possible, and the nature of the bulk material being processed may be taken into account—for instance, apparatus catering for voluminous leafy branches may be of larger size than a drum being fed municipal waste in bags.

The outer comminution drum is substantially drum-like in configuration and typically substantially cylindrical or barrel shaped (mild frustro-conical shapes may be entertained in some embodiments, as well as a variety of other hollow shapes having rotational symmetry about a central longitudinal axis). The central longitudinal axis of the drum also represents the preferred rotational axis for embodiments in which the outer comminution drum is rotatable.

The outer comminution drum may be supported by a variety of known means. Where it is rotatable, then support may be by way of one or more of: support rollers, supporting axles, supporting half axles, and supporting bearing arrangements—these will be well known to the skilled worker, and reference may also be made to the prior art specifications of the applicant. As operation of preferred embodiments of the comminution apparatus relies on relatively tight tolerances and clearances, the support arrangement for the outer comminution drum should be able to maintain the comminution drum in substantially the same position (at least relative to the inner drum)—whether empty, loaded, or processing waste.

In preferred embodiments the outer comminution drum may be inclined, typical ranges being such that the outer drum's longitudinal axis is within the inclusive range of 0-30° from the horizontal. This can assist with feeding raw waste into the drum, and preventing spilling from the drum.

Within the hollow portion of the outer comminution drum is one or more inner comminution drums. For simplicity of description, we shall refer to a single inner comminution drum though it should be noted that the same general principles would apply to additional inner comminution drums when present.

An inner comminution drum is typically cylindrical drum-like in appearance, though would generally approximate the internal configuration of the hollow portion of the outer comminution drum. The inner comminution drum may be solid or hollow, though should be sufficiently rigid not to flex while processing material. Hence, the term 'drum' is used loosely in relation to the inner comminution drum, and in some configurations/embodiments may also be referred to as a roller—for simplicity the term 'drum' will be used in this description.

The diameter of the inner comminution drum is small enough to fit inside the outer comminution drum, and to allow sufficient remaining space within the outer comminution drum to accommodate waste material for processing. While the ratio of the outer diameter of an inner comminution drum to the inner diameter of the outer comminution drum is user selectable, preferred embodiments fall within an inclusive ratio of 1:2 through 1:10 with most preferred embodiments falling within the inclusive ratio of 1:2.8 through 1:4.

The inner comminution drum may be stationary or rotatable. In a preferred embodiment, both the outer and inner comminution drums are rotatable. In less preferred embodiments at least one of the inner and outer comminution drums are rotatable, so we have rotational movement of either of an inner or outer comminution drum relative to the other.

In preferred embodiments the rotation of inner and outer comminution drums are independent of each other, though this need not be so in all embodiments—in some embodiments rotation of inner and outer comminution drums may be linked or set at a particular (tangential velocity (at point of closest approach)) ratio to each other Independent rotational speed control shall be discussed in more detail later herein.

For simplicity we shall refer from hereon, unless otherwise noted, to preferred embodiments in which both the inner and outer comminution drums are driven and rotatable. These embodiments will describe the features and principles affecting simpler embodiments in which both drums are not driven: In these latter cases, the 'rotational axis' shall refer to the longitudinal axis of rotational symmetry for a non-rotating drum (or that most closely approximating a longitudinal axis of rotational symmetry).

The rotational axes of both the inner and outer comminution drums will be typically be substantially parallel to each other, though not coaxial—the axis of the inner comminution drum will be offset from that of the outer comminution drum. The outer surface of an inner comminution drum will typically be in close proximity to the inner surface of the outer comminution drum. What close proximity represents is potentially dependent upon a number of factors, most notable the size and type of projecting macerating features providing on the inner and/or outer comminution drums.

The projecting macerating features are primarily responsible for the comminution of waste material within the hollow portion of the outer comminution drum. Typically these projecting macerating features are provided on both the outer surface of the inner comminution drum, and inner surface of the outer comminution drum. Ideally they come close together during operation of the apparatus, and ideally intermesh (when viewed in at least one direction) during relative motion of the surface of one drum relative to the other (i.e. relative motion between the surfaces of an inner and outer drum).

In preferred embodiments it is this close proximity which draws waste material in and macerates it into broken or comminuted pieces. Hence, the position in which an inner comminution drum is located is such that its projecting macerating features come close to the inner surface of the outer comminution drum. The closest distance of approach is ideally equal to or less than the height by which the projecting macerating features (of the inner drum) rise above the general surface of the inner comminution drum.

As mentioned there are also projecting macerating features present on the inner surface of the outer comminution drum, and these should also come in close proximity to the outer surface of an inner comminution drum. Again, the distance of closest approach (from the top of a projecting macerating feature to the outer general surface of the inner comminution drum) is ideally less than the height by which the projecting macerating feature extends above the inner surface of the outer comminution drum.

When dealing with softer or smaller materials, the distance of closest approach may be less. Where more problematic or harder materials are present, the distance of closest approach may be increased, and may in some circumstances be up to 3 times the distance according to the preferred criteria mentioned above.

The projecting macerating features may comprise ridges, serrated ribs, or other projecting features. They may also comprise grooves or channels to accommodate projecting features on the other drum. Such recessed features may also be modified to interact with waste material—e.g. they may have barbs, serrations, teeth, or other features.

The projecting macerating features in preferred embodiments comprise teeth, or groups of teeth (for easy installation or replacement). These may have hardened tips (e.g. tungsten carbide, toughened and/or hardened steels, etc.) depending on the type of materials which may be present. In preferred embodiments, tooth profiles which can exert a tearing or ripping action as the encounter an object are used, to help tear apart fibrous and stringy materials. An extended leading nose profile may also help to cut into metal (e.g. tins and cans) and to shatter brittle materials such as glass. Such teeth may interact with recessed features such as apertures, or as described above, on the other drum.

Projecting macerating features may also comprise other features. Raised abrasive and roughened surfaces may be provided to provide an abrasive action on waste materials. Examples include larger versions of surfaces typically found on industrial abrasive pads for powered machinery, through to carborundum and diamond impregnated surfaces, etc.

Cutting surfaces which cut or grate materials may also be utilised on various embodiments. These surfaces may, as an illustrative example, resemble the surfaces found on typical kitchen graters. Arrays of blades in close proximity may also be used to effect a cutting action on materials.

In practice, on or more combinations of projecting macerating features may be used, though in a preferred embodiment teeth with a projecting-leading nose portion are used.

In addition, on preferred embodiments, the projecting macerating features on the outer and inner drums come into close proximity to each other when measured along a direction (such as in FIG. 1) parallel to the longitudinal axes of the drums (the close proximity of alternating teeth (i.e. alternating between adjacent drums) is best seen in FIGS. 6 and 7). Hence, materials being drawn between the drums in an ever tightening distance, cannot easily avoid the teeth (or other macerating feature) by diverting to either side of the tooth or feature it is encountering. Instead, because teeth are side by side next to each other (the actual arrangement is more complex than this, which will be discussed below), the material is ultimately forced between a tooth and the surface of the other drum rather than merely passing either side of a tooth or projecting macerating feature. By positioning teeth (i.e. projecting macerating feature) side by side adjacently in close proximity (albeit in an alternating arrangement on the two drums) we avoid a combing effect by the teeth on the waste material, and instead introduce a strong shearing effect—particularly if the relative surface speeds of the drums differ and we have the additional action of one set of teeth (i.e. projecting macerating feature) attempting to draw waste material through a tight gap between two adjacent teeth on the opposite drum—this will become more readily apparent in the accompanying illustrations.

Hence, ideally when travelling along the direction of the longitudinal axes of the drums (assuming the drums are parallel in this example), we shall see the teeth of one drum alternating in position with the teeth of the other drum as we travel along the axis—however in the illustrated preferred arrangement the teeth of each drum are also arranged helically, rather than just linearly (as per a simpler embodiment). This potential intermeshing between alternating teeth creates a strong shearing effect as previously mentioned, which tends to tear apart and macerate most waste material—including fibrous material, and film material (e.g. many plastics). This shearing effect can be increased when there is a difference in the tangential velocities of the inner and outer drums.

While each projecting macerating features could extend about the entire circumference of each drum with which it is associated, it is instead preferred that individual projecting macerating features which extend only a portion of the circumference of a drum are used. Hence in preferred embodiment, each projecting macerating feature is a tooth element. This arrangement is considered to assist in grabbing and drawing irregularly shaped articles between the drums for maceration.

Further, aligning the projecting macerating features in a linear row so that all of the teeth on both the inner and outer comminution drums intermesh (when viewed along a direction parallel to a said drum longitudinal axis) simultaneously can place a high instantaneous load on the drums, their teeth, and drive motors. So as to avoid and even out such loadings, preferred embodiments progressively stagger the projecting macerating features about the circumference of the drum as one travels in a direction parallel to the longitudinal axis of the drum. Where the projecting macerating features are teeth, the resulting distribution patterns of teeth about the drum surface appears helical (see figures). A potentially realisable advantage here is that rather than instantaneously loading all teeth simultaneously as the drum(s) rotate, load is progressively introduced to new teeth as one travels in the aforesaid longitudinal direction. Hence any load from intermeshing teeth is small and localised (and continually moving), rather than being on the entire drum simultaneously. Also the loading on motors is substantially continuous—rather than periodically alternating between low and high loads. This allows for the use of less powerful drive motors, and typically greater efficiency.

By providing multiple helical patterns of teeth about a drum's exposed surface (i.e. inner and outer drums) there can be several localised load points simultaneously along the drum. By arranging the helical pattern(s) of projecting macerating features appropriately, these localised load points can be relatively evenly distributed along the length of a drum at one time. This arrangement places much less stress on the drums and apparatus, while the progressive tooth (i.e. projecting macerating feature) engagement action between drums appears to be quite effective in drawing irregularly sized materials of differing compositions between the drums for maceration.

As can be appreciated, the action of the present invention as described is significantly different in action to the action of a typical paper shredder which has two equivalent shafts supporting intermeshing raised circumferential projecting disc portions. In such designs (and industrial sized versions are apparently known), there is a high load on the motors and apparatus at all times, except when idling. They are best suited for waste of a uniform nature in which the presented loads are constant, and accordingly these devices are very sensitive to foreign objects, and tend not to handle moist and varied waste well at all. Their design also makes them prone to clogging, and their action is often more dependent on a continuous cutting action—potentially fine if the fibres of fibrous materials are aligned perpendicularly to the cutting action; an impossible task.

Waste added to the hollow portion of the outer comminution drum will eventually become progressively comminuted. To enable the removal of sufficiently comminuted material, the outer comminution drum ideally has a plurality of screening apertures distributed about it. These are generally selected to allow material of a predetermined nominal size to pass through and be collected (e.g. in a hopper, or by conveyor, etc.). Reference may be made to the applicant's other patent applications (WO/2005/092509 and WO/2006/093421) which describes the possible options which may be employed in screening apertures, as well as size selection and distribution etc.

The screening apertures may also be part of removal plates, enabling plates to be changed for maintenance or when differently sized or shaped apertures are required for a particular type of material to be processed (or when the user has different requirements).

Load sensors may also be utilised to monitor the operation of the apparatus, and ultimately to influence control thereof. These may typically be associated with either or both of inner and outer comminution drums—particularly those which may be driven. A preferred type of load sensing is torque sensing which measures the torque being applied to the drum in order to rotate at a particular speed. These devices are well known for electrical, hydraulic, and other types of motors and drive means. While other load sensing means may be used, for simplicity we shall talk in the following example in terms of sensed torque.

When a high torque, over a predetermined threshold is encountered on one or more of the sensors, this may be indicative of a jamming of the apparatus by a foreign object. At this stage several scenarios may be effected (by way of example):

i) the apparatus is stopped for manual clearing of an obstruction;

ii) the apparatus is reversed then stopped for manual clearing of an obstruction;

iii) the apparatus is reversed, then restarted (optionally at a different speed);

iv) the sequence of option (iii) is performed and if an obstruction is then re-sensed, then the sequence of option (iii) is repeated a predetermined number of times, and should the obstruction not be dealt with by the repeated reversing and restarting, then the sequence of option (i) or (ii) occurs;

v) information is sent to an operator who can select what options are to occur, with possible failsafe options (such as in (i) through (iv) above) if no action is taken.

In the above scenarios the apparatus can help prevent irreversible damage by either stopping for manual intervention, or performing a sequence of steps in order to attempt to correct the problem prior to stopping for manual intervention. It is considered that for many possible obstructions (which may for example comprise a slightly thicker diameter piece of branch or larger piece of refuse) the reversal and restarting (which can introduce the offending item at a different angle to the drums) will often address the problems. When the apparatus is finally halted for manual intervention, it is likely to be as a consequence of a foreign item too large or problematic to be handled by the apparatus.

Load and torque sensing can also be used to optimise the efficiency of the apparatus. When there are light loads detected, it is considered that the relative rotational speed of the inner to outer comminution drums should be lower than when a high load is present. For instance, when there is a light load (i.e. <25% of the maximum rated load of the drive means for the drums) then the ratio of the rotational speed (in rpm) of the inner:outer drums should be within the inclusive range of 0.25:1 to 1:3 (nominally around 1:1).

Under a high load (i.e. >70% of the maximum rated load of the drive means for the drums) then the ratio of the rotational speed (in rpm) of the inner:outer drums should be within the inclusive range of 1:7 to 1:15 (nominally around 1:10).

When operating at a preferred medium load (25-70% of the maximum rated load of the drive means for the drums) then the ratio of the rotational speed (in rpm) of the inner:outer drums should be within the inclusive range of 1:3 to 1:7 (nominally around 1:5).

In the above examples of rotational speed, the rotational diameter of the inner to outer drum is within the range of 1:2.5 to 1:5 inclusive (nominally 1:3). For diameter ranges outside of these, then the preferred rotational speed ratios of inner: outer drums may be calculated so as to provide the same ratio of tangential speeds (between inner and outer drums at the point of closest point of approach of the inner and outer drums) as would a system with a 1:3 diameter ratio operating at the aforesaid rotational speed ratios.

As can be appreciated, the inclusion of load sensing and motor control provides enhanced options allowing for dealing with possible obstructions and optimising the comminution of material. It is considered that the actual values on an implemented embodiment may be optimised for the particular embodiment and the type of material it is processing.

Loading and removing screened material may be by conventional means including: conveyors, chutes, hoppers, bucket loaders, etc. Techniques which may be employed have been discussed in the applicant's prior applications (WO/2005/092509 and WO/2006/093421) and may be employed in relation to the present invention.

A transportable unit mounted on a trailer, vehicle, or wagon is also envisaged. Again reference is made to the transportable examples of the applicant's prior applications.

Aspects of the present invention will now be described by way of example only with respect to the accompanying drawings.

BRIEF DESCRIPTION OF THE DRAWINGS

Further aspects of the present invention will become apparent from the following description which is given by way of example only.

BEST MODES FOR CARRYING OUT THE INVENTION

Figures 1, 2:
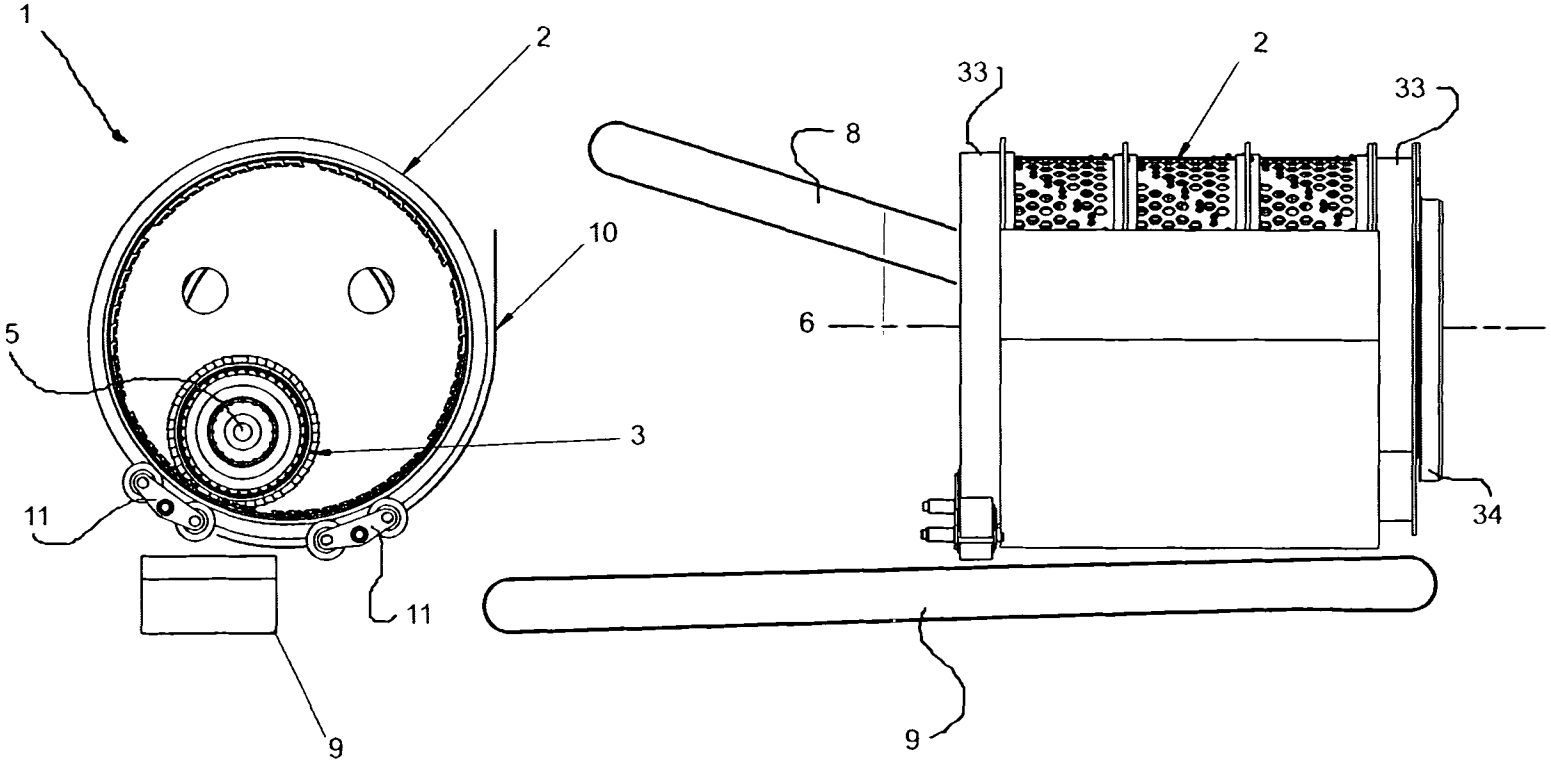
FIG. 1 an end view diagrammatic of an embodiment of comminution apparatus according to the present invention.
FIG. 2 is a side diagrammatic view of the embodiment of FIG. 1.

FIG. 1 illustrates comminution apparatus (generally indicated by arrow 1) comprising an outer comminution drum (2) and inner comminution drum (3). They are typically manufactured of metal, typically a suitable steel. Stainless steels may be used where appropriate.

The outer comminution drum (2) is substantially cylindrical in configuration and has a hollow portion (4) in which the inner comminution drum (3) is located.

The outer comminution drum (2) has a central longitudinal axis (6) which is also its rotational axis. The inner comminution drum (3) also has a central longitudinal axis (5) which is also its rotational axis.

Drive means (not shown for clarity) comprising either or both hydraulic or electric motors power the rotation of the inner (3) and outer (2) comminution drums substantially independently of each other (i.e. the rotational speed of one or either can be altered without affecting the rotational speed of the other). Both drums rotate clockwise in the view of FIG. 1.

Raw material can be fed into the hollow portion (4) by feed conveyor (8) whilst conveyor (9) removes collected screened material for collection. A shielding panel (10) helps direct screened comminuted material to conveyor (9).

In FIG. 1, supporting roller sets (11) for the outer comminution drum (2) are shown.

Figure 3:
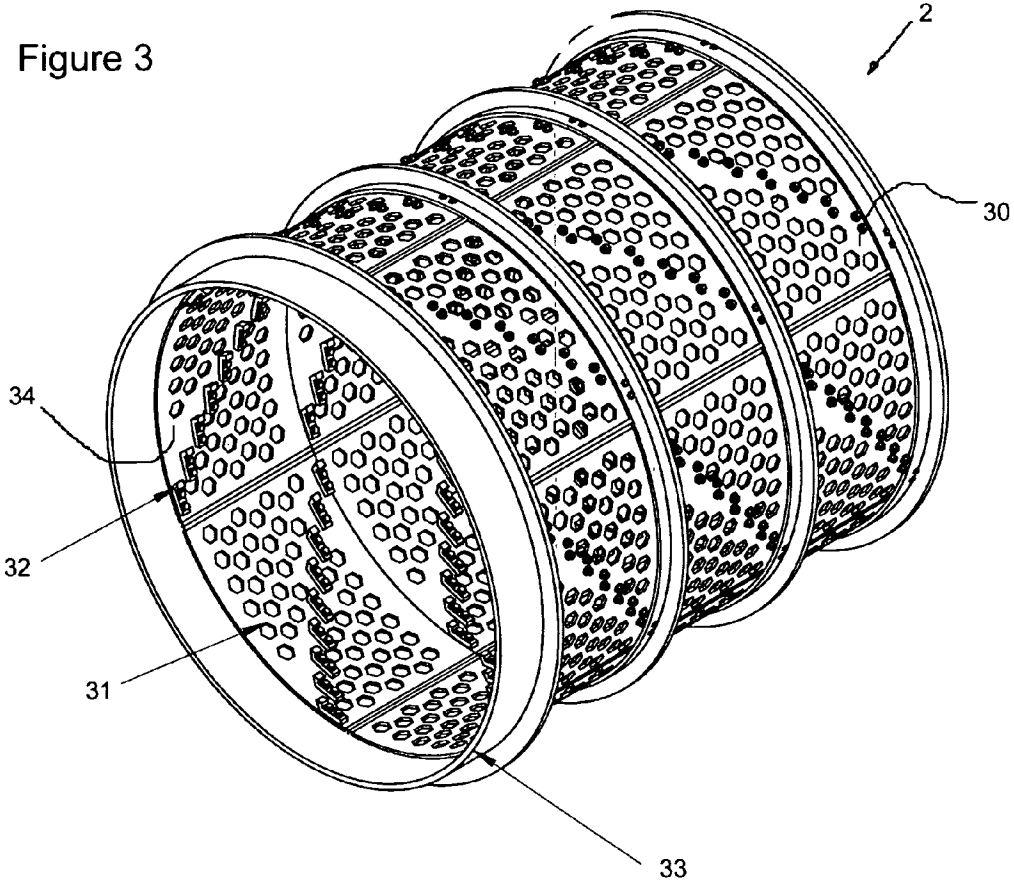
FIG. 3 is a perspective diagrammatic view of the outer comminution drum of the embodiment of FIG. 1.

FIG. 3 illustrates an embodiment of an outer comminution drum (2). Removable screening panels (30) comprise a plurality of screening apertures (31) to allow sufficiently comminuted material to fall/pass through.

Also affixed to the panels (30) are projecting macerating features comprising a plurality of teeth (32) distributed in several helical patterns about the inner surface of the outer comminution drum (2). These teeth are removable for replacement or substitution of differently shaped teeth (for different types of waste according to user choice). The multiple helical arrangements of individual teeth (32) are clearly seen in FIG. 3.

At the front end of the outer comminution drum (2) is a support ring (33) which rests upon the support roller sets (11). Such a ring and roller set may also be provided at the opposite end of the outer comminution drum, and/or a bearing arrangement (34) relied upon. Additional ring (33) and roller sets (11) may be provided along the length of the outer comminution drum (2).

Figure 5:
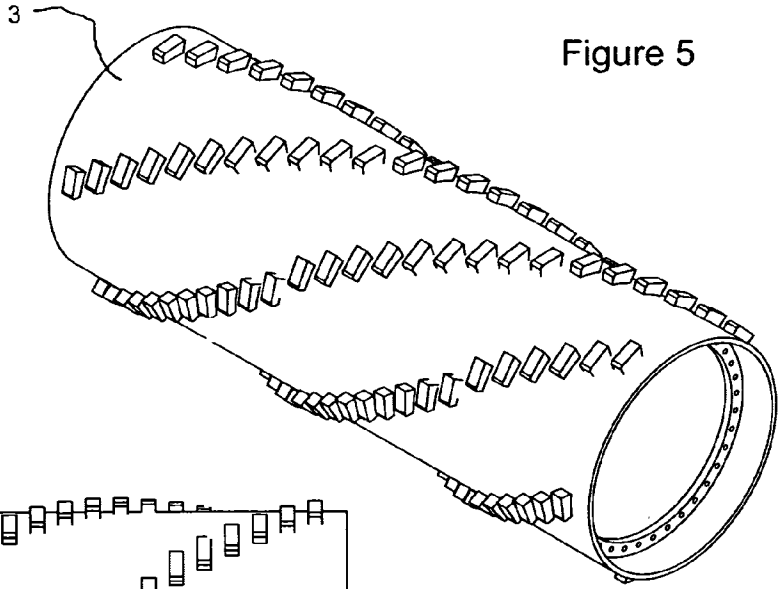
FIG. 5 a perspective diagrammatic view of the inner comminution drum of the embodiment of FIG. 1.
Figure 4:
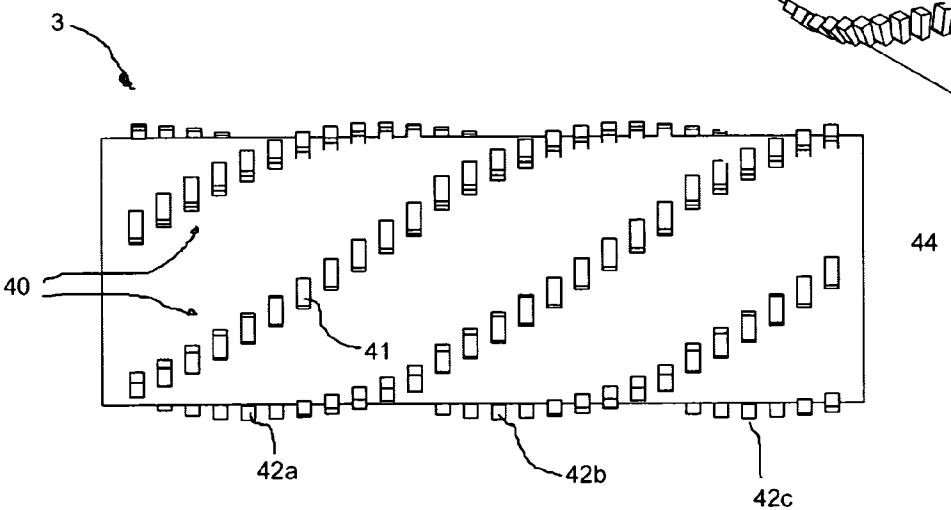
FIG. 4 is a side diagrammatic view of the inner comminution drum of the embodiment of FIG. 1.

FIGS. 4 and 5 illustrate the inner comminution drum (3) which may be hollow in construction. The drum (3) also possesses projecting macerating features (40) comprising multiple helically distributed arrays of teeth (41). These teeth (41) may be identical to those (32) on the outer comminution drum (reducing the amount of replacement parts which need to be kept in stock).

If we look at the bottom of the drum (3) in FIG. 4, which we shall take (in this example) as being the point of closest approach of the inner drum's (3) outer surface to the inner surface of the outer comminution drum (2), we see that several teeth (42*a-c*) are at their downward most point. It is these teeth (and those in adjacent proximity to them) which are actually acting upon and macerating waste material. As these represent the primary load and stress points on drum (3) when it is in this rotational position, it can be appreciated that rather than having a load along the entire length of drum (3) at once, it is instead restricted to several evenly distributed regions. This helps to spread the instantaneous effective load acting on the drum (3) via its teeth (41) along the length of the drum (3).

As the drum (3) continues to rotate, successively adjacent teeth attain the lowermost position, and these represent the new highest load position. As can be appreciated, as the drum (3) rotates, the positions of the regions of highest load or stress are constantly moving along the length of the drum (3).

The same principles apply to the teeth (32) and outer comminution drum (2) which also arranges its teeth (32) in helical arrangements. The main load and stress points on the outer comminution drum (2) are thus also distributed along its length and constantly moving as it rotates.

Figure 7:
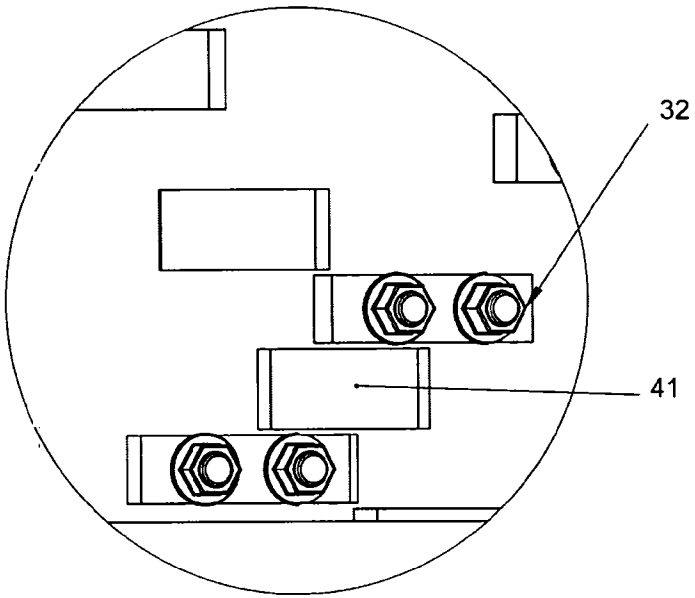
FIGS. 6 and 7 are schematic views illustrating the interaction of teeth of the embodiment of FIG. 1.
Figure 6:
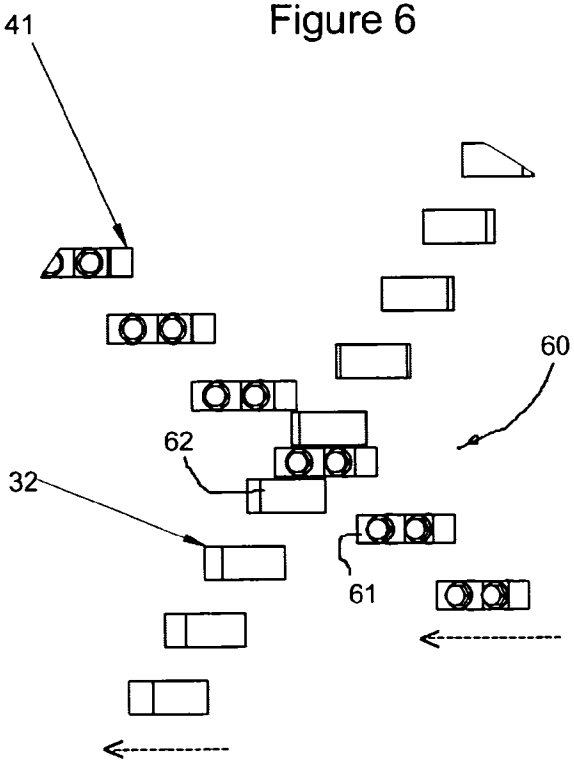

FIGS. 6 and 7 illustrate also the relationship of the teeth (32, 41). As the drums (2, 3) are moving at differing speeds, the tangential velocities of the teeth under most circumstances (the rotational speeds of the drums (2, 3) are variable in this example according to load) will also be different. Consequently we have two macerating effects in action.

The first effect is due to a tooth (32, 41) coming into close proximity to the surface (34, 44) of the other drum than that to which it is attached. This macerates material through a shearing effect as it is attempted to be forced into the small gap (less than the height of a tooth) between the tooth and opposing surface.

Secondly, the teeth (32, 41) of the drums (2, 3) are arranged so their rotational paths follow alternating concentric rings—e.g. a tooth (32) follows an annular path adjacent the annular path of a tooth (41) of the other drum, followed then by the annular path of the next tooth (32) and so on. This general arrangement is most clearly seen in FIG. 5.

Accordingly we have teeth (32, 41) from both drums (2, 3) continually passing in close side by side proximity to each other (as generally indicated in the region signified by arrow 60). This introduces a further macerating effect acting on material as it is pushed by one tooth (61) as it passes a tooth (62) of the other drum—for this exercise we shall assume that tooth (62) is travelling faster (linear tangential velocity) than tooth (62) (though this relationship will depend on the relative rotational speeds and diameters of the inner and outer drums (2, 3)).

As can be appreciated we have two macerating effects continually occurring at constantly changing points within the apparatus. Hence, in a typical scenario, different macerating effects are progressively occurring on single articles of waste within the apparatus. A consequence is that articles are constantly being acted upon in at least two ways, which can help alter their orientation and position within the comminution mix being processed. This agitation potentially improves the efficiency of screening as articles are continually represented to screening apertures at different orientation.

Further, the dual macerating actions, are currently thought to be more effective in dealing with fibrous and stringy materials, with less possibility of clogging.

Not shown in the pictures, but present in the embodiment illustrated are torque sensors and motor control. The torque sensors sense the load on the individual motors driving the inner (3) and outer (2) comminution drums. The sensors then (through a control circuit) vary the rotational speed of the inner and outer drums according to the following criteria.

When a high torque, over a predetermined threshold (being a sensed load in excess of 90% of the maximum rated load of the drive means for either of the drums) is encountered:

i) the apparatus is reversed, then restarted at a low speed;

ii) if an obstruction is then re-sensed, then the sequence of option (i) is repeated a predetermined number of times (ideally from 3 to 5), and should the obstruction not be dealt with by the repeated reversing and restarting, then the sequence of the apparatus is reversed and then stopped for manual intervention;

Speed control of the motors is as follows:

i) when there is a light load (i.e. <25% of the maximum rated load of the drive means for the drums) then the ratio of the rotational speed (in rpm) of the inner:outer drums should be within the inclusive range of 0.8:1 to 1:2 (nominally around 1:1).

ii) when there is a high load (i.e. >70% of the maximum rated load of the drive means for the drums) then the ratio of the rotational speed (in rpm) of the inner:outer drums should be within the inclusive range of 1:8 to 1:12 (nominally around 1:10).

iii) when operating at a preferred medium load (25-70% of the maximum rated load of the drive means for the drums) then the ratio of the rotational speed (in rpm) of the inner:outer drums should be within the inclusive range of 1:4 to 1:6 (nominally around 1:5).

Aspects of the present invention have been described by way of example only and it should be appreciated that modifications and additions may be made thereto without departing from the spirit or scope of the present invention as described herein.

It should also be understood that the term "comprise" where used herein is not to be considered to be used in a limiting sense. Accordingly, 'comprise' does not represent nor define an exclusive set of items, but includes the possibility of other components and items being added to the list.

This specification is also based on the understanding of the inventor regarding the prior art. The prior art description should not be regarded as being authoritative disclosure on the true state of the prior art but rather as referencing considerations brought to the mind and attention of the inventor when developing this invention.

The claims defining the invention are:

1. Comminution apparatus comprising:

an outer comminution drum; and an inner comminution drum, said outer comminution drum having a hollow portion and having a longitudinal axis, said inner comminution drum having a longitudinal axis and positioned within said hollow portion outer comminution drum, said longitudinal axes being substantially parallel to each other, but not coaxial, said outer and inner comminution drums, being rotatable about their respective longitudinal axes;

said inner comminution drum having outwardly directed inner drum projecting macerating features on its outer surface, said outer comminution drum having inwardly directed outer drum projecting macerating features on its inner surface, wherein during rotation of said inner and outer comminution drums, said outwardly directed inner drum projecting macerating features, and said inwardly directed outer drum projecting macerating features, periodically pass side by side adjacently at a closest approach of the outer surface of said inner comminution drum to the inner surface of said outer comminution drum, in a side by side intermeshing of their paths relationship; side by side being with reference to circular paths said projecting macerating features follow; and wherein during rotation of said outer comminution drum, and said inner comminution drum, about their longitudinal axes said projecting macerating features come into close proximity, but do not make contact, with each other nor with the surface of the other comminution drum.

2. Comminution apparatus as claimed in claim 1 in which an outwardly directed inner drum projecting macerating features comprises one or more of: a tooth, a grouping of teeth, an abrasive element, a raised projection; and in which said outwardly directed inner drum projecting macerating features are arranged in a helical fashion about the outer surface of said inner comminution drum.

3. Comminution apparatus as claimed in claim 1 in which an inwardly directed outer drum projecting macerating features comprises one or more of: a tooth, a grouping of teeth, an abrasive element, a raised projection;

and in which said inwardly directed outer drum projecting macerating features are arranged in a helical fashion about the inner surface of said outer comminution drum.

4. Comminution apparatus as claimed in claim 1 in which the relative positions of the inner and outer comminution drums are such that projecting macerating features on either or both come into close proximity to the other comminution drum than that with which said projecting macerating features are associated, but do not contact; close proximity being a distance less than the maximum height that a projecting macerating feature rises above the general surface of the comminution drum from which it projects; and in which both said inner and outer comminution drums rotate relative to each other.

5. Comminution apparatus as claimed in claim 1 in which, additionally, the outwardly directed inner drum projecting macerating features come into close proximity to the general surface of the outer comminution drum, and the inwardly directed outer drum projecting macerating features come into close proximity to the general surface of an inner comminution drum; close proximity being a distance less than the maximum height that a projecting macerating feature rises above the general surface of the comminution drum from which it projects.

6. Comminution apparatus as claimed in claim 1 in which each of said inner and outer comminution drums is able to be rotated independently of the other.

7. Comminution apparatus as claimed in claim 6 in which each comminution drum is driven.

8. Comminution apparatus as claimed in claim 7 in which the driven rotational speed of each drive comminution drum is variable according to the determined load acting on one or more drums.

9. Comminution apparatus as claimed in claim 8, in which both inner and outer comminution drums are rotatable, and are driven to rotate within an a relative ratio of 1:1 to 1:10 inclusive representing the ratio of inner:outer drum rotational speed in revolutions per minute.

10. Comminution apparatus as claimed in claim 9, in which the ratio of driven speeds of inner and outer comminution drums are variable and in which the ratio of driven speeds of the inner and outer comminution drums are varied according to the determined load acting on one or more drums.

11. Comminution apparatus as claimed in claim 10 in which the determined load relies on detecting the actual load acting on the one or more drums and in which the determined load relies on information from a torque sensor on the one or more drums.

12. Comminution apparatus as claimed in claim 11 including load sensing means for assessing the load on either or both of inner and outer comminution drums and wherein for a sensed light load less than 25% of the maximum rated load of the drive means for the drums whose load is monitored, then the ratio of the rotational speed (in rpm) of the inner:outer drums should be within the inclusive range of 0.25:1 to 1:3.

13. Comminution apparatus as claimed in claim 8 in which at least one comminution drum is capable of reverse rotation.

14. Comminution apparatus as claimed in claim 13 in which reverse rotation is initiated when a determined load acting on the one or more drums exceeds a predetermined threshold.

15. Comminution apparatus as claimed in claim 7 in which when a high torque, over a predetermined threshold is encountered on one or more of torque sensors, drive means for either or both of inner and outer comminution drums is controlled to effect at least one of:

i) the apparatus is stopped for manual clearing of an obstruction;

ii) the apparatus is reversed then stopped for manual clearing of an obstruction;

iii) the apparatus is reversed, then restarted optionally at a different speed;

iv) the sequence of option (iii) is performed and if an obstruction is then re-sensed, then the sequence of option (iii) is repeated a predetermined number of times, and should the obstruction not be dealt with by the repeated reversing and restarting, then the sequence of option (i) or (ii) subsequently occurs;

v) information is sent to an operator who can select what options are to occur, with failsafe options (such as in (i) through (iv) above) if no action is taken.

16. Comminution apparatus as claimed in claim 7 including load sensing means for assessing the load on either or both of inner and outer comminution drums and wherein for a sensed high load greater than 70% of the maximum rated load of the drive means for the drums whose load is monitored then the ratio of the rotational speed (in rpm) of the inner:outer drums should be within the inclusive range of 1:7 to 1:15.

17. Comminution apparatus as claimed in claim 1 in which the ratio of the outer diameter of an inner drum to the inner diameter of the outer drum is within the inclusive range of 1:2 through to 1:10.

18. Comminution apparatus as claimed in claim 1 in which the outer drum includes a plurality of screening apertures.

19. Comminution apparatus as claimed in claim 1 in which the longitudinal axis of the outer comminution drum is within the range of 0-30° to the horizontal.

20. Comminution apparatus as claimed in claim 1 which includes a feed conveyor to load raw material to inside the hollow portion of the outer comminution drum.

* * * * *